United States Patent [19]

Nakada et al.

[11] 3,987,333

[45] Oct. 19, 1976

[54] MAGNETRON COMPRISING A RADIALLY MAGNETIZED PERMANENT MAGNET AND AN AXIALLY MAGNETIZED PERMANENT MAGNET

[75] Inventors: Kusuo Nakada, Ichihara; Yoshio Ishida, Mobara, both of Japan

[73] Assignee: Hitachi, Ltd., Tokyo, Japan

[22] Filed: July 21, 1975

[21] Appl. No.: 597,465

[30] Foreign Application Priority Data

July 24, 1974 Japan ..... 49-84189

[52] U.S. Cl. ..... 315/39.71; 315/39.51; 315/39.77

[51] Int. Cl.[2] ..... H01J 25/50

[58] Field of Search ..... 315/39.51, 39.71, 39.77

[56] References Cited

UNITED STATES PATENTS

| | | | |
|---|---|---|---|
| 3,376,466 | 4/1968 | Gerard | 315/39.71 |
| 3,412,285 | 11/1968 | Gerard | 315/39.77 X |
| 3,479,556 | 11/1969 | Cook | 315/39.77 X |
| 3,855,498 | 12/1974 | MacMaster et al. | 315/39.71 |
| 3,914,644 | 10/1975 | Gerard | 315/39.77 |

*Primary Examiner*—Saxfield Chatmon, Jr.
*Attorney, Agent, or Firm*—Charles E. Pfund

[57] ABSTRACT

In a magnetron comprising a cathode electrode, an anode cylinder including a plurality of vanes disposed about the cathode electrode for defining an interaction space, and a pair of permanent magnets contained in the anode cylinder for producing magnetic field in the interaction space, one permanent magnet is magnetized in the radial direction whereas the other is magnetized in the axial direction whereby the magnetic field distribution in the interaction space is made uniform.

15 Claims, 4 Drawing Figures

MAGNETRON COMPRISING A RADIALLY MAGNETIZED PERMANENT MAGNET AND AN AXIALLY MAGNETIZED PERMANENT MAGNET

BACKGROUND OF THE INVENTION

This invention relates to a magnetron, and more particularly to a magnetron of the type wherein permanent magnets are disposed within the anode cylinder.

In a prior art magnetron, permanent magnets are arranged on the outside of the anode cylinder and magnetic yokes are used to form magnetic circuits. In the magnetron of this type since the permanent magnets are positioned remote from the interaction space between the cathode and anode electrodes, the leakage flux is increased and the utilization factor of the magnetic field is only few percent. For this reason, it is necessary to increase the size of the permanent magnets and the yokes for the purpose of providing magnetic field of the desired strength. Accordingly, there are problems of decreasing the size and the cost of manufacturing.

Recently, it has been proposed to dispose the permanent magnets in the anode cylinder for the purpose of increasing the utilization factor of the magnetic field thereby decreasing the size and cost of manufacturing. Such construction is disposed for example in Japanese Pat. application No. 50156/1972 filed May 17, 1972 (Layed open specification No. 15358/1974 published Feb. 9, 1974) entitled "Magnetron".

FIG. 1 of the accompanying drawing shows a longitudinal section of one example of the magnetron of this type in which the anode comprises an anode cylinder 12 made of ferromagnetic material and a plurality of vanes 11 secured to the cylinder 12 for defining a plurality of cavities. A cathode electrode 13 is supported about the axis of the anode cylinder 12 by means of a cathode support 14 to form the interaction space between the cathode electrode 13 and the vanes 11. Upper vacuum seal wall 15 and lower vacuum seal wall 16 are provided for the opposite ends of the anode cylinder 12. An annular ring shaped first permanent magnet 17 is mounted on the inside of the upper vacuum seal wall 15 by a frusto conical shaped support 18 made of stainless steel, for example, and provided with a central opening, and a short cylindrical second permanent magnet 19 is secured to the inner side of the lower vacuum seal wall 16 by means of a bonding agent. These first and second permanent magnets are magnetized in the axial direction of the anode cylinder 12. The upper and lower vacuum seal walls 15 and 16 are respectively provided with a cathode input terminal 20 for the cathode electrode 13 and an output antenna 21 which is also used as the exhaust tube. The cathode input terminal 20 is supported by an insulating bushing 25 made of ceramic, for example, and filter casings 22 and 23 containing filters for preventing unwanted leakage radiation is also mounted on the insulating bushing 25. The output antenna 21 is supported by an insulating bushing 26 made of ceramic, for example. A plurality of heat radiating plates 31 are secured on the outer surface of the anode cylinder 12.

In this manner, by disposing the first and second permanent magnets 17 and 19 in an evacuated casing formed by the upper and lower vacuum sealing walls 15 and 16 it is possible to eliminate a large outside yoke and outside permanent magnets which are necessary for the prior art construction thereby greatly reducing the weight and the size of the magnetron tube. However, there are still following disadvantages. Firstly, since the first permanent magnet 17 on the side of the cathode input terminal 20 is annular and the second permanent magnet 19 on the side of the output antenna 21 is a short cylinder, and since both permanent magnets are magnetized in the axial direction of the anode cylinder 12 the magnetic flux flows through a magnetic path has shown by a. Thus, after leaving the first permanent magnet 17 the flux flows toward the second permanent magnet 19 while converging toward the center of the interaction space. Consequently, as shown by P in FIG. 2, the flux density curve in the interaction space will incline. In FIG. 2, the abscissa represents the position along the axis of the anode cylinder, whereas the ordinate the flux density. As can be noted from FIG. 2, the flux density decreases toward the upper portion of the interaction space thus resulting in a non-uniform flux distribution. This broadens abnormal oscillation region which is generally called a moding region, thereby causing a undesired oscillation at the time of high efficiency operations. Thus, where it is desired to provide a $\pi$ mode oscillation, for example, oscillations other than the $\pi$ mode would result. Where the outer diameter of the first permanent magnet 17 is increased by taking into consideration the fact that it is impossible to utilize strong magnetic field on the side of the first permanent magnet, leakage flux flowing through a magnetic path *b* shown in FIG. 1 increases thus short-circuiting the effective magnetic path *a*. Thus, mere increase of the size of the first permanent magnet does not result in any advantageous effect. For the reasons described above, in the magnetron of the type shown in FIG. 1 there are such disadvantages that the flux density in the interaction space is low so that it is difficult to obtain magnetrons capable of producing high outputs with small and compact design.

SUMMARY OF THE INVENTION

Accordingly, it is an object of this invention to provide an improved magnetron in which the flux distribution in the interaction space is made uniform thereby preventing undesirable oscillations.

Another object of this invention is to provide an improved magnetron wherein the flux density in the interaction space is made uniform in the axial direction of the magnetron tube so as to make narrow the unstable region for the purpose of preventing undesirable oscillations.

Still another object of this invention is to provide a magnetron capable of producing large outputs with a small size.

Yet another object of this invention is to provide an improved magnetron capable of limiting the temperature rise of the permanent magnets caused by the heat radiated from the cathode electrode or the support thereof thereby minimizing the variation in the intensity of the magnetic field caused by the temperature rise and hence the variation in the microwave output.

According to this invention these and other objects can be accomplished by providing a magnetron of the type comprising a cathode electrode, an anode cylinder including a plurality of vanes disposed about the cathode electrode, the vanes defining an interaction space therebetween, and a pair of permanent magnets for producing magnetic field in the interaction space, characterized in that one of the permanent magnet is magnetized in the radial direction of the anode cylinder, and that the other permanent magnet is magnetized in the axial direction of the anode cylinder thereby making uniform the magnetic field distribution in the interaction space.

The radially magnetized permanent magnet is annular and may be composed of a plurality of sector shaped sections.

DESCRIPTION OF THE PREFERRED EMBODIMENTS

Figure 1:
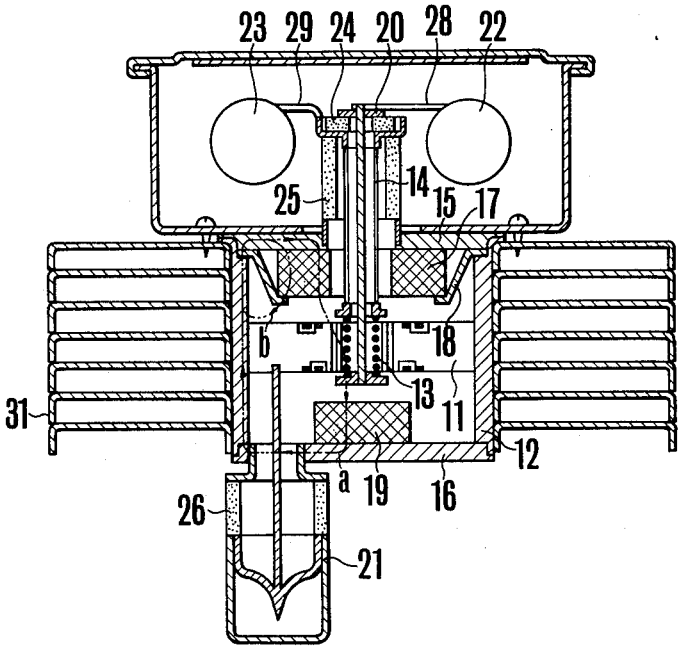
FIG.1 PRIOR ART
FIG. 1 is a longitudinal sectional view of one example of a prior art magnetron.
Figure 2:
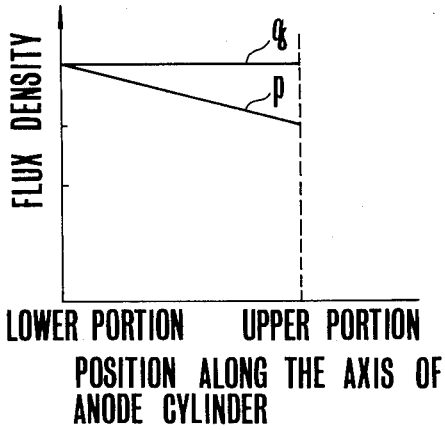
FIG. 2 is a graph showing the distribution of the magnetic field of the novel magnetron of this invention and of a prior art magnetron.
Figure 3:
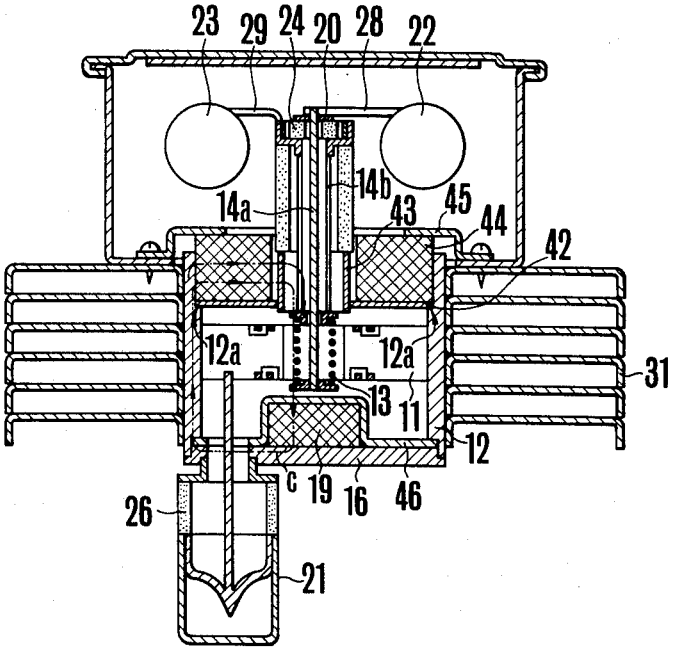
FIG. 3 is a longitudinal sectional view of one example of the magnetron embodying the invention and FIG. 4 is a perspective view showing the construction of a modified annular permanent magnet utilized in the magnetron shown in FIG. 3.

FIG. 3 shows a longitudinal sectional view of one embodiment of this invention in which elements corresponding to those shown in FIG. 1 are designated by the same reference numerals. The magnetron shown in FIG. 3 comprises a flat annular vacuum seal member 42 made of non-magnetic material such as stainless steel, and a cylindrical vacuum seal member 43 made of magnetic material. The vacuum seal member 42 is located in coaxial relation with the anode cylinder 12 on a shoulder 12*a* at a small distance from the upper end of the anode cylinder. The lower end of the vacuum seal member 43 is soldered to the periphery of the central opening of the vacuum seal member 42. An annular first permanent magnet 44 is mounted on the annular vacuum seal member 42 with its periphery contacted with the inner surface of the anode cylinder 12. The first permanent magnet 44 is held in position by means of an annular clamping plate 45 made of non-magnetic material such as stainless steel. A second permanent magnet 19 is secured on the lower vacuum seal wall 16 close to the output antenna 21 by a non-magnetic clamping member 46. The first permanent magnet 44 is magnetized in the radial direction whereas the second permanent magnet 19 is magnetized in the axial direction.

The outer periphery of the first permanent magnet 44 is magnetically coupled with the anode cylinder 12 whereas the lower end of the second permanent magnet 19 is magnetically coupled with the anode cylinder 12 through the lower vacuum seal wall 16 and the magnetic circuit is completed by the first permanent magnet 44, anode cylinder 12, lower vacuum seal wall 16, and second permanent magnet 19. Where the first permanent magnet 44 is magnetized such that its inner periphery forms an N pole and the outer periphery an S pole and the second permanent magnet 19 is magnetized such that its upper surface forms an S pole and the lower surface in contact with the lower vacuum seal wall 16 forms an N pole the magnetic flux C passes from the central opening of the first permanent magnet where the flux concentrates, axially through the anode cylinder 12 to the upper surface of the second permanent magnet. As a result, the magnetic flux C passes perpendicularly through the interaction space at uniform density throughout the height thereof. Moreover, since the first permanent magnet 44 is magnetized in the radial direction as above described there is no leakage flux as in the case of FIG. 1. Even when the permanent magnets 44 and 19 are magnetized in the directions opposite to those described above, uniform flux density can be obtained in the interaction space.

In this embodiment, since one permanent magnet is magnetized in the radial direction and the other in the axial direction of the anode cylinder the flux density in the interaction space becomes uniform in the axial direction whereby it is possible to prevent undesirable oscillation when the magnetron is operating at high efficiencies. Moreover, as the pair of permanent magnets are disposed in the anode cylinder so as to magnetically couple the permanent magnets with the anode cylinder and the vacuum seal wall connected thereto there is formed a magnetic circuit free from leakage flux. Accordingly, it is possible to concentrate all fluxes from the first permanent magnet in the interaction space thus increasing the intensity of the flux and the output of the magnetron. Moreover, as the first permanent magnet 44 is mounted on the outside of the vacuum seal member 42 which is used to define an evacuated envelope it is possible to limit the temperature rise of the first permanent magnet 44 because the heat radiated from the cathode electrode 13 and cathode supporting member 14*a* and 14*b* is substantially absorbed by the vacuum seal members 42 and 43 which cover the first permanent magnet. As a consequence it is possible to minimize the variations in the strength of the magnetic field and the microwave output caused by the temperature rise. The reason of clamping the cylindrical permanent magnet against the lower vacuum seal wall 16 by the clamping member 46 is that when the magnet is bonded to the lower vacuum seal wall 16 with a bonding agent as has been the practice in the past such bonding will be caused to peel off by heat.

As has been pointed out above, the vacuum seal member 42 should be made of non-magnetic material but the cylindrical vacuum seal member 43 through which the flux passes may be made of ferro-magnetic material for the purpose of adjusting the flux distribution. The correction of the flux path in the interaction space may be made by changing the shape of the vacuum seal member 43 or by providing suitable magnetic member associated with the vacuum seal member 43.

Alternatively, the first permanent magnet may be positioned in the evacuated casing. In this case, however, the variation in the strength of the magnetic field caused by the heat radiated from the cathode structure increases more or less. So long as the first permanent magnet is disposed above the anode cylinder the same advantageous effect as above described embodiment can be realized.

Although in the foregoing description the output antenna 21 is connected to the periphery of the lower vacuum seal member 16 it will be clear that the output antenna may be connected to the side wall of the evacuated casing. Where the output antenna is connected to the side wall it is not necessary for the second permanent magnet to be cylindrical. In such a case the second permanent magent may be annular like the first permanent magnet.

Figure 4:
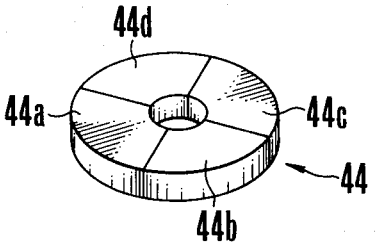

Each permanent magent may be fabricated from segments instead of forming the magnet as an integral structure. FIG. 4 shows an annular permanent magnet 44 made up of four sector shaped permanent magnet segments 44*a*, 44*b*, 44*c* and 44*d*. With this construction it is easy to magnetize the magnets in the radial direction. More particularly, after being magnetized by a well known method, the segments are bonded into an annular shape with a bonding agent.

In the foregoing description, the directions of magnetization of the permanent magnets were defined with respect to the anode cylinder but the direction of magnetization of the first permanent magnet may be slightly different from the radial direction of the anode cylinder. It is also possible to construct the anode cylinder of a combination of ferromagnetic material and a material having a high heat conductivity such as copper. Further, the clamping member 45 is not limited to a single annular body but may comprise a plurality of sections provided that it can clamp the permanent magnet 44.

As has been described hereinabove the invention provides an improved magnetron wherein a pair of permanent magnets is disposed inside of the anode cylinder, one of the permanent magnets is magnetized in the axial direction of the anode cylinder and the other permanent magnet is magnetized in the radial direction. Accordingly it is possible not only to reduce the size, weight, material and cost of the permanent magnets but also to make uniform the flux density in the interaction space thereby assuring high output, stable operation and high efficiency.

While the radially magnetized permanent magnet has been exemplified in FIG. 4 as an annular magnet constructed by putting together a plurality of sector-shaped permanent magnet segments, it is advisable to radially arrange elongated permanent magnet segments each magnetized in its longitudinal direction with one end of the same polarity concentrated to the axis of the anode cylinder since it is essential to generate the magnetic flux in the radial direction. Preferably, end surfaces of the elongated permanent magnet segments are on an assumed circle around the anode cylinder axis without forming a space between end surfaces of adjacent segments. More preferably, the end surface is arcuated along the assumed circle.

What is claimed is:

1. In a magnetron of the type comprising a cathode electrode, an anode cylinder including a plurality of vanes disposed about said cathode electrode, said vanes and said cathode electrode defining an interaction space therebetween, and a pair of permanent magnets which confront each other through said interaction space in a ferromagnetic circuit including said anode cylinder for producing magnetic field in said interaction space, the improvement wherein one of the permanent magnets is magnetized in the radial direction and the other permanent magnet is magnetized in the axial direction thereby making uniform the magnetic field distribution in said interaction space.

2. The magnetron according to claim 1 wherein said permanent magnets are disposed inside of said anode cylinder.

3. The magnetron according to claim 1 wherein said one permanent magnet magnetized in the radial direction takes the form of an annulus and said other permanent magnet magnetized in the axial direction takes the form of a cylinder.

4. The magnetron according to claim 1 wherein said permanent magnets are disposed concentrically with said anode cylinder.

5. The magnetron according to claim 3 wherein the outer periphery of said annular permanent magnet is in contact with the inner wall of said anode cylinder, a part of said annular permanent magnet protruding from one end of said anode cylinder.

6. The magnetron according to claim 5 wherein said annular permanent magnet is mounted on a vacuum seal member supported on a shoulder formed in said anode cylinder.

7. The magnetron according to claim 6 wherein said vacuum seal member comprises an annular ring and said magnetron further comprises a cylindrical vacuum seal member secured to the central opening of said annular ring, a cathode input terminal mounted on one end of said cylindrical vacuum seal member remote from said interaction space through an annular insulating member, and a support for said cathode electrode, said support extending from said input terminal through said cylindrical seal member and said annular insulating member.

8. The magnetron according to claim 6 wherein said magnetron further comprises a clamping member which clamps said one permanent magnet magnetized in the radial direction between said clamping member and said vacuum seal member.

9. The magnetron according to claim 3 wherein said one permanent magnet magnetized in the radial direction comprises a plurality of sector shaped sections.

10. The magnetron according to claim 4 wherein each one of said pair of permanent magnets are annular.

11. In a magnetron of the type comprising a cathode electrode, an anode cylinder including a plurality of vanes disposed about said cathode electrode, said vanes and said cathode electrode defining an interaction space therebetween, a pair of permanent magnets in a ferromagnetic circuit including said anode cylinder for producing magnetic field in said interaction space, and a plurality of heat radiating plates disposed on the outer periphery of said anode cylinder, the improvement wherein said pair of permanent magnets are disposed in said anode cylinder, one of the permanent magnets is magnetized in the radial direction, and the other permanent magnet is magnetized in the axial direction thereby making uniform the magnetic field distribution in said interaction space.

12. The magnetron according to claim 11 wherein said pair of permanent magnets is disposed in said anode cylinder on the opposite sides of said vanes, the outer periphery of said one permanent magnet magnetized in the radial direction is in contact with the inner wall of said anode cylinder, and said other permanent magnet magnetized in the axial direction is mounted on a magnetic member arranged to close the opening of said anode cylinder.

13. The magnetron according to claim 12 wherein said one permanent magnet magnetized in the radial direction is annular and mounted on a non-magnetic vacuum seal wall supported by a shoulder formed on the inner wall of said anode cylinder, and said other permanent magnet magnetized in the axial direction is secured to said magnetic member and a second non-magnetic vacuum seal wall.

14. The magnetron according to claim 13 wherein said vacuum seal wall supporting said one permanent magnet magnetized in the radial direction is annular, and said magnetron further comprises a non-magnetic cylindrical vacuum seal wall which is inserted in the central opening of said one permanent magnet and secured to the central opening of said annular vacuum seal wall.

15. The magnetron according to claim 12 wherein said one permanent magnet magnetized in the radial direction is annular and mounted on a non-magnetic vacuum seal wall supported by a shoulder formed on the inner wall of said anode cylinder.

* * * * *